United States Patent [19]

Mitome

[11] Patent Number: 4,914,749

[45] Date of Patent: Apr. 3, 1990

[54] METHOD CAPABLE OF EXTRACTING A VALUE OF A SPECTRAL ENVELOPE PARAMETER WITH A REDUCED AMOUNT OF OPERATIONS AND A DEVICE THEREFOR

[75] Inventor: Yukio Mitome, Tokyo, Japan

[73] Assignee: NEC Corporation, Tokyo, Japan

[21] Appl. No.: 665,852

[22] Filed: Oct. 29, 1984

[30] Foreign Application Priority Data

Oct. 27, 1983 [JP] Japan ..... 58-201387

[51] Int. Cl.[4] ..... G10L 7/02

[52] U.S. Cl. ..... 381/41

[58] Field of Search ..... 381/29-50; 364/513.5, 485, 487

[56] References Cited

U.S. PATENT DOCUMENTS

| | | | |
|---|---|---|---|
| 3,566,035 | 2/1971 | Noll et al. | 381/41 |
| 3,649,765 | 3/1972 | Rabiner et al. | 381/39 |
| 3,681,530 | 8/1972 | Manley et al. | 381/32 |
| 4,076,960 | 2/1978 | Boss et al. | 364/513.5 |
| 4,219,695 | 8/1980 | Wilkes et al. | 381/47 |

OTHER PUBLICATIONS

Childers, "The Cepstrum: A Guide to Processing", Proceedings of the IEEE, vol. 65, No. 10, Oct. 1977, pp. 1428-1442.

Moll, "Short-time Spectrum and Cepstrum Techniques for Vocal-Pitch Detection", J. Acoustic. Soc. Amer., vol. 35, pp. 296-302, Feb. 1964.

Schafer et al., "System for Automatic Formant Analysis of Voiced Speech", J. Acoustical Soc. Amer., vol. 47, No. 2, pp. 634-648, 1970.

Jack et al., "Waveform Detection and Classification with Saw Cepstrum Analysis", IEEE Trans on Aerospace and Elec. Sys., vol. AES-13, No. 6, Nov. 1977, pp. 610-614.

Furui, "Cepstral Analysis Technique for Automatic Speaker Verification", IEEE Trans. ASSP, vol. ASSP-29, No. 2, Apr. 1981, pp. 254-272.

*Primary Examiner*—David L. Clark

*Assistant Examiner*—John A. Merecki

*Attorney, Agent, or Firm*—Sughrue, Mion, Zinn, Macpeak & Seas

[57] ABSTRACT

A logarithmic frequency spectrum related to an input signal is converted by the use of an inverse Fourier transform into a cepstrum. The cepstrum has a first and a second frequency component which have a first peak and a second peak spaced apart from the first peak by a preselected period on an axis of frequency, respectively. The second frequency component is processed into a peak controlled frequency component having a controlled peak coincident with the first peak. The peak controlled frequency component and the first frequency component are summed up to produce an ultimate frequency component which corresponds to the value of the envelope parameter.

5 Claims, 2 Drawing Sheets

METHOD CAPABLE OF EXTRACTING A VALUE OF A SPECTRAL ENVELOPE PARAMETER WITH A REDUCED AMOUNT OF OPERATIONS AND A DEVICE THEREFOR

BACKGROUND OF THE INVENTION

This invention relates to a method of extracting a value of a spectral envelope parameter which specifies a logarithmic spectrum related to an input signal and which may simply be called an envelope parameter. This invention relates also to a device for use in carrying out the method.

It is important to accurately extract the value of the envelope parameter specifying the logarithmic spectrum of a speech signal in order to reduce the amount of information of the speech signal for storage or for transmission and to carry out speech recognition. It is often necessary to extract the value of the envelope parameter for other signals.

On extracting the value of the envelope parameter for the speech signal, a conventional method is to extract the value of the envelope parameter from a cepstrum related to the speech signal. The cepstrum is obtained by carrying out an inverse Fourier transform of a logarithmic spectrum of the speech signal. As will later be described in detail, the cepstrum is given along an axis of frequency and has a first and a second frequency component which indicate an approximate envelope of the logarithmic spectrum and a fine configuration of the logarithmic spectrum, respectively. From the cepstrum, the first quefrency component is extracted to provide the value of the envelope parameter. However, the first quefrency component does not indicate a true envelope of the logarithmic spectrum but merely the average of the fine configuration of the logarithmic spectrum. The conventional method is therefore incapable of providing an accurate value of the envelope parameter.

An improved method is disclosed by Satoshi IMAI and Yoshiharu ABE in a Japanese technical paper, "Densi Tūsin Gakkai Ronbunshi (A)" (The Transactions of the Institute of Electronics and Communication Engineers of Japan, (A)), Vol. J62-A (1979), pages b 217–223 1 (April), under the title of "Kairyō Kepusutoramu Hō ni yoru Supekutoru Hōraku no Chushutsu" (Spectral Envelope Extraction by Improved Cepstral Method). The method of Imai et al provides the accurate value of the envelope parameter by producing a corrected quefrency component indicative of the true envelope of the logarithmic spectrum. As will later be described in detail, the corrected quefrency component is produced by correcting the first quefrency component by the use of the second quefrency component. However, the Imai et al method requires a great number of operations in order to produce the corrected quefrency component from the first quefrency component. This is because correction of the first quefrency component needs calculation of the Fourier transform repeatedly several times and of the inverse Fourier transform also several times.

SUMMARY OF THE INVENTION

It is therefore an object of this invention to provide a method capable of extracting a value of an envelope parameter specifying a logarithmic spectrum related to an input signal with a reduced amount of operations.

Other object of this invention will become clear as the description proceeds.

A method to which this invention is applicable, is for monitoring a logarithmic spectrum which is related to an input signal and which appears along an axis of frequency, and for extracting a value of an envelope parameter specifying said logarithmic spectrum. The logarithmic spectrum is variable along the axis of frequency and comprises a first variable frequency component providing an approximate envelope of the logarithmic spectrum and a second variable frequency component superposed on the first variable frequency component to make the approximate envelope fluctuate in relation to a preselected frequency. The logarithmic spectrum is converted by the use of the inverse Fourier transform into a cepstrum which is given along an axis of frequency and has a first frequency component corresponding to the first variable frequency component and a second frequency component corresponding to the second variable frequency component. The first and the second frequency components have a first peak at a predetermined frequency and a second peak remote from said first peak by an amount dependent upon the preselected frequency, respectively. According to this invention, the method comprises the steps of controlling the second frequency component to produce a peak controlled frequency component having a controlled peak coincident with the first peak and summing up the first frequency component and the peak controlled frequency component to produce a third frequency component corresponding to the value of the envelope parameter.

DESCRIPTION OF THE PREFERRED EMBODIMENTS

Figure 1:
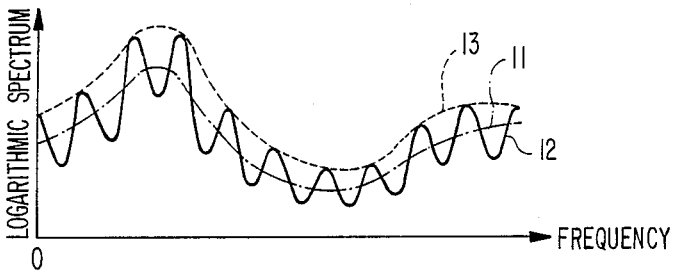
FIG. 1 shows an example of a logarithmic spectrum of an input signal.

Referring to FIG. 1, a conventional method will be described for a better understanding of this invention. The conventional method is similar to that described in the preamble of this specification. It will be assumed that an input signal has a logarithmic spectrum along an axis of frequency. The logarithmic spectrum is obtained by the Fourier transform of the input signal, in the manner known in the art. The logarithmic spectrum may vary along the axis of frequency as exemplified in FIG. 1.

The illustrated logarithmic spectrum is divisible into a coarse undulant component 11 and a fine undulant component 12 superposed on the coarse undulant component 11. The coarse undulant component 11 specifies an approximate envelope or configuration of the logarithmic spectrum and will be referred to as a first frequency component. The fine undulant component 12 specifies a fine outline or configuration of the logarithmic spectrum together with the first frequency component and will be referred to as a second frequency component. The illustrated second frequency component 12 varies like a sinusoidal wave having a preselected frequency or period. Thus, a superposition of the first and the second frequency components 11 and 12 provides the logarithmic spectrum.

In the conventional method, the first frequency component 11 alone is used to determine an envelope parameter of the logarithmic spectrum because the first frequency component 11 provides the approximate envelope. However, the approximate envelope is somewhat different from a true envelope 13 given by a superposition of the first and the second frequency components 11 and 12. Therefore, an accurate envelope parameter can not be obtained with the conventional method.

Referring to FIG. 2 and again to FIG. 1, description will be made as regards another conventional method which is substantially equivalent to the method of Imai et al briefly described in the preamble of the instant specification. The logarithmic spectrum illustrated in FIG. 1 is subjected at first to an inverse Fourier transform and then is converted into a cepstrum which is defined along an axis of time and which will be described more in detail in the following. This is similar to the conventional method described with reference to FIG. 1.

Figure 2:
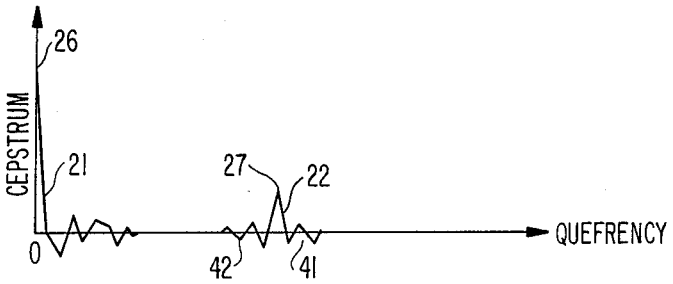
FIG. 2 shows a cepstrum which is given by carrying out the inverse Fourier transform of the logarithmic spectrum of FIG. 1.

It may be mentioned here that the "time" will be called "quefrency" like the cepstrum. The axis of time may therefore be called an axis of quefrency as labelled in FIG. 2. In FIG. 2, an origin O is coincident with a reference time instant and defines an ordinate which may be named a reference axis. The illustrated cepstrum comprises a low or first quefrency component 21 adjacent to the origin O and a high or second quefrency component 22 remote from the first quefrency component 21. The first and second quefrency components 21 and 22 may be called a short and a long time component, respectively. The first and the second quefrency components 21 and 22 have respective first and second cepstrum peaks 26 and 27 at the time origin O and at a preselected quefrency remote from the time origin O. Although a negative half of the cepstrum is omitted from FIG. 2, the cepstrum is symmetrical with respect to the reference axis. This is because a positive half of the cepstrum may be considered to determine the envelope parameter of the logarithmic spectrum.

The Imai et al method carries out the Fourier transform of the second quefrency component 22 to produce an additional spectrum which is variable towards a positive and a negative side of a predetermined level. Thus, the additional spectrum has a positive and a negative component corresponding to those upper and lower portions of the second frequency component 12 (FIG. 1) which are laid above and under the first frequency component 11, respectively. Subsequently, the negative component is made zero by the nonlinear processing known in the art, with the positive component kept intact. The positive component is subjected to the inverse Fourier transform again and converted into an additional cepstrum having a short time component and a long time component. The short time component of the additional cepstrum is added to the first quefrency component 21. A similar operation is repeated as regards the above-mentioned long time component to derive a further long time component from the long time component of the additional cepstrum.

Thus, each short time component of the cepstra is successively summed up in the above-mentioned manner. As a result, the sum gradually approaches the true envelope 13 (FIG. 1) and an accurate envelope parameter can be obtained with the Imai et al method.

However, a succession of operations should be repeatedly carried out several times in order to determine the envelope parameter in question. Therefore, a great number of calculations are necessary in the Imai et al method as described in the preamble of the instant specification.

Figure 3:
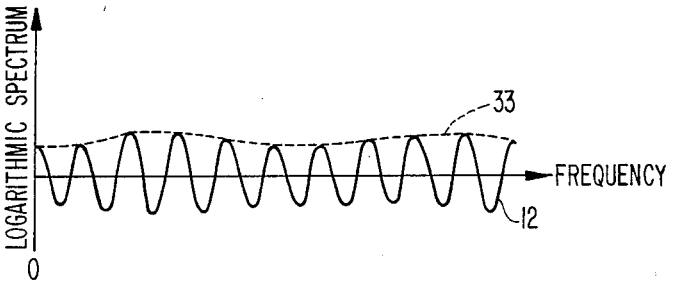
FIG. 3 shows a fine configuration of the logarithmic spectrum of FIG. 1.
Figure 4A:
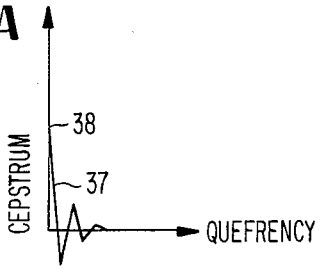
FIGS. 4(A) and 4(B) are views for use in describing a method according to a first embodiment of this invention.

Referring to FIGS. 3 and 4(A) and (B) together with FIGS. 1 and 2, description will at first be made as regards a method according to a first embodiment of this invention. It is assumed that the second frequency component 12 is separated from the first frequency component 11, as illustrated in FIG. 3. Such separation of the second frequency component 12 is equivalently possible by separating the first and the second quefrency components 21 and 22 (FIG. 2) from each other on the axis of quefrency.

In FIG. 3, the second frequency component 12 has a fine configuration and varies towards a positive and a negative side of a zero level. Now, let an upper envelope 33 be detected from the second frequency component 12 separated from the first frequency component 11. The upper envelope 33 is what would be coincident with the true envelope 13 when the first frequency component 11 is rendered coincident with the zero level. In other words, the true envelope 13 is given by a sum of the upper envelope 33 and the first frequency component 11.

The second frequency component 12 illustrated in FIG. 3, is specified by the sinusoidal wave varying at the preselected period along the axis of frequency. In the meantime, the second frequency component 12 can be recognized as an amplitude modulated wave appearing on the axis of frequency by modulating the sinusoidal wave of the preselected period by a signal defining the upper envelope 33. As regards the second quefrency component 22 corresponding to the second frequency component 12, the second cepstrum peak 27 (FIG. 2) is spaced apart from the time origin O by the period of the sinusoidal wave on the axis of quefrency.

Let envelope detection of the second quefrency component 12 be carried out on the axis of frequency to determine the upper envelope 33. The envelope detection along the axis of frequency is equivalent to an operation of shifting, on the axis of quefrency, the second cepstrum peak 27 to the time origin O (FIG. 2) at which the first cepstrum peak 26 is present.

As shown in FIG. 2, the second quefrency component 22 comprises first and second parts 41 and 42 in addition to the second cepstrum peak 27. The first part 41 is higher in quefrency than the second cepstrum peak 27 while the second part 42 is not higher in quefrency than the second cepstrum peak 27. The first and the second parts 41 and 42 are not always symmetrical with respect to the preselected quefrency at which the second quefrency component 22 has the second cepstrum peak 27.

Accordingly, it is necessary to fold the second quefrency component 22 with respect to the preselected quefrency on carrying out the shifting operation of the second quefrency component 22. Otherwise, an accurate envelope parameter can not be attained even with this method.

Taking the above into consideration, the second quefrency component 22 is folded with respect to the preselected quefrency in a manner to be presently described. On folding the second quefrency component 22, the second part 42 is inverted with respect to the second cepstrum peak 27 as regards the quefrency. The second part 42 thereby becomes an inverted quefrency part. Subsequently, the inverted quefrency part is superposed on the first part 41 to form a folded quefrency component having a fold axis coincident with the second cepstrum peak 27.

As shown in FIG. 4(A), the folded quefrency component is shifted to the time origin O in the above-mentioned manner so that the fold axis is coincident with the first cepstrum peak 26. The shifted and folded quefrency component is thus processed into a peak controlled quefrency component 37 having a controlled peak 38. Thus, the second quefrency component 22 is controlled to produce the peak controlled quefrency component 37.

Figure 4B:
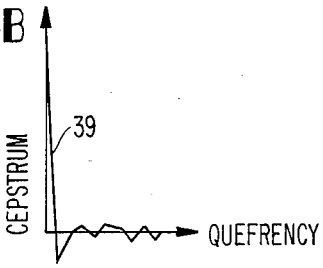

Under the circumstances, the peak controlled quefrency component 37 and the first quefrency component 21 are summed up into an ultimate quefrency component 39 shown in FIG. 4(B). The ultimate quefrency component 39 specifies an envelope parameter representative of the true envelope 13 (FIG. 1), as readily understood from the above. Accordingly, a value of the envelope parameter can be extracted from the ultimate quefrency component 39.

Referring to FIGS. 1 through 4 again, a method according to a second embodiment of this invention processes the second quefrency component 22 in consideration of a negative half of a cepstrum in addition to a positive half thereof.

As suggested before, the cepstrum (as illustrated in FIG. 2) appears with axial symmetry on both sides of a predetermined quefrency, namely, the time origin O. This means that the first quefrency component is accompanied by a negative quefrency component and that the second quefrency component 22 is accompanied by a third quefrency component which is symmetrical with respect to the second quefrency component 22 on both sides of the cepstrum axis (FIG. 2). The third quefrency component has a third cepstrum peak which is symmetrical relative to the second cepstrum peak 27 with respect to the cepstrum axis. The third quefrency component further has a first and a second symmetrical part which are symmetrical relative to the first and the second parts 41 and 42 with respect to the cepstrum axis, respectively. Therefore, the first symmetrical part is farther from the time origin O than the second symmetrical part.

The second quefrency component 22 is at first combined with the third quefrency component to obtain an intermediate quefrency component representative of a combination of the second and the third quefrency components.

More specifically, the first part and the second symmetrical part are superposed on each other into the intermediate quefrency component after they are separated from the second and the third quefrency components, respectively. Alternatively, the second part and the first symmetrical part may be superposed on each other to form the intermediate quefrency component.

The intermediate quefrency component serves as the peak controlled quefrency component 37 and is added to the first quefrency component 21. Thus, the ultimate quefrency component 39 is attained as in the method according to the first embodiment of this invention.

It is possible with this method to obtain the accurate value of the envelope parameter from the first and the second quefrency components 21 and 22 without iterative performance of the Fourier transform and inverse Fourier transform.

Figure 5:
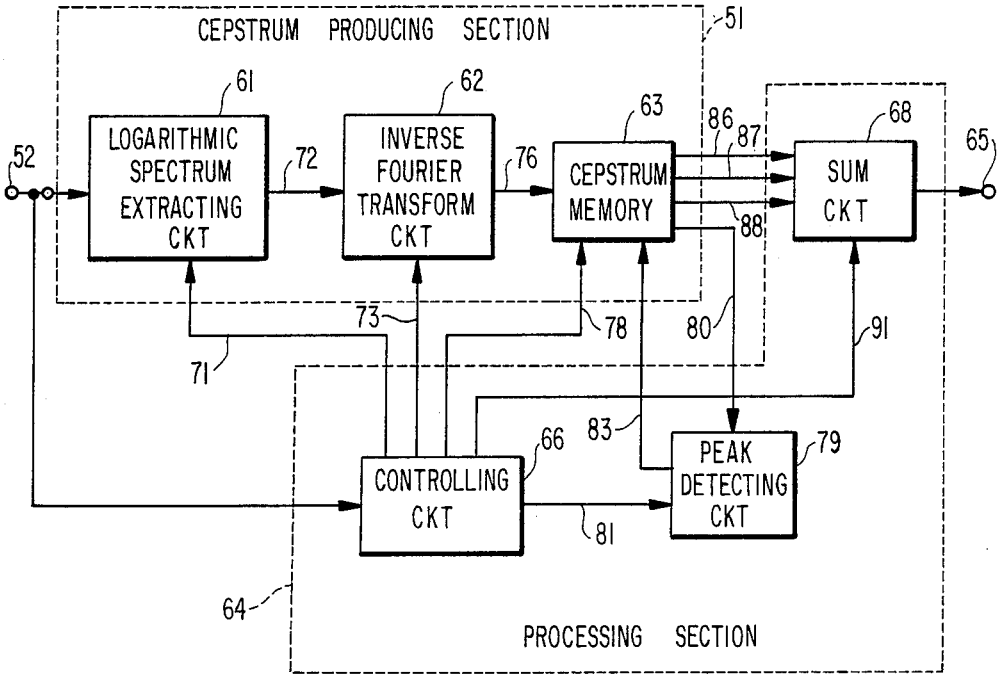
FIG. 5 shows a block diagram of a device capable of realizing the method according to the first embodiment of this invention.

Referring to FIG. 5 together with FIGS. 1 through 4, a device is shown which is capable of realizing the method according to the first embodiment of this invention. The device comprises a cepstrum producing section 51 supplied with the input signal through an input terminal 52. The cepstrum producing section 51 is for producing a cepstrum signal. The cepstrum signal is representative of the cepstrum and is divided into a first and a second partial cepstrum signal representative of the first and the second quefrency components 21 and 22, respectively. The first and the second quefrency components 21 and 22 have first and second cepstrum peaks 26 and 27, respectively.

More particularly, the cepstrum producing section 51 comprises a logarithmic spectrum extracting circuit 61 for extracting the logarithmic spectrum as shown in FIG. 1 from the input signal, an inverse Fourier transform circuit 62 for carrying out the inverse Fourier transform of the logarithmic spectrum to get cepstrum values specifying the cepstrum as shown in FIG. 2, and a cepstrum memory 63 for storing the cepstrum values in the form of the cepstrum signal. The logarithmic spectrum extracting circuit 61 and the inverse Fourier transform circuit 62 are known in the art. The cepstrum memory 63 is a mere memory circuit.

A processing section 64 is coupled to the cepstrum producing section 51 for processing the cepstrum signal to make the first cepstrum peak 26 coincide with the second cepstrum peak 27 and to calculate a sum of the first and the second quefrency components 21 and 22 having the first and the second cepstrum peaks 26 and 27 coincident with each other. The processing section 64 supplies an output terminal 65 with an output signal specifying the value of the envelope parameter in the manner described with reference to FIGS. 1 through 4.

For this purpose, the processing section 64 comprises a controlling circuit 66 energized in response to the input signal to carry out a control operation, as will become clear as the description proceeds. Supplied with the input signal, the controlling circuit 66 sends a first control signal to the logarithmic spectrum extracting circuit 61 through a first control signal transmission line 71. Responsive to the first control signal, the logarithmic spectrum extracting circuit 61 carries out the Fourier transform of the input signal to supply the inverse Fourier transform circuit 62 through a spectrum transmission line 72 with a logarithmic spectrum signal representative of the logarithmic spectrum.

Subsequently, the controlling circuit 66 sends a second control signal to the inverse Fourier transform circuit 62 through a second control signal transmission line 73.

Supplied with the second control signal, the inverse Fourier transform circuit 62 carries out the inverse Fourier transform of the logarithmic spectrum signal to send the cepstrum signal to the cepstrum memory 63 through a first cepstrum transmission line 76. The cepstrum signal is stored in the cepstrum memory 63.

Thereafter, the controlling circuit 66 sends a third control signal to the cepstrum memory 63 through a third control signal transmission line 78. Responsive to the third control signal, the cepstrum memory 63 selects the second partial cepstrum signal representative of the second quefrency component 22 and supplies the selected second partial cepstrum signal to a peak detecting circuit 79 through a second cepstrum transmission line 80.

Next, the controlling circuit 66 delivers a fourth control signal to the peak detecting circuit 79 through a fourth control signal transmission line 81. Supplied with the fourth control signal, the peak detecting circuit 79 detects the second cepstrum peak 27 of the second quefrency component 22 and a time instant at which the second cepstrum peak 27 appears. The peak detecting circuit 79 supplies the cepstrum memory 63 through a time transmission line 83 with a time signal indicative of the time instant of the second peak 27.

Subsequently, the controlling circuit 66 sends a fifth control signal to the cepstrum memory 63 through the third control signal transmission line 78. In this event, the cepstrum memory 63 delivers the first quefrency component 21 to the sum circuit 68 through a third cepstrum transmission line 86. The first quefrency component 21 is laid in a restricted positive region on the axis of quefrency, as shown in FIG. 2 and successively read out of the cepstrum memory 63 from the time origin O towards the positive direction of quefrency at a preselected rate.

The part 42 of the second frequency component 22 is read out of the cepstrum memory 63 from the second peak 27 towards the negative direction of quefrency and is sent through a fourth cepstrum transmission line 87 to the sum circuit 68 at the same rate as the first quefrency component 21. Furthermore, the first part 41 of the second frequency component 22 is read out of the cepstrum memory 63 from the second peak 27 towards the positive direction of quefrency and sent to the sum circuit 68 through a fifth cepstrum transmission line 88 like the second partial part 42. The above-mentioned readout operation in the positive and the negative directions of quefrency is equivalent to adjustment of the first and the second peaks 26 and 27.

The controlling circuit 66 delivers a sixth control signal to the sum circuit 68 through a fifth control signal transmission line 91 after production of the fifth control signal. Responsive to the sixth control signal, the sum circuit 68 calculates a sum of the first quefrency component 21 and the first and the second parts 41 and 42 to supply the output terminal 65 with the above-mentioned output signal. The output signal represents the sum of the above-mentioned component and parts. The output signal specifies the value of the envelope parameter.

While this invention has thus far been described in conjunction with a few embodiments thereof, it will readily be possible for those skilled in the art to put this invention into practice in various other manners. For example, it is possible to use a logarithmic spectrum of electric power of the input signal. Thus, the logarithmic spectrum may be related to the input signal. When the second frequency component 12 is specified by a distorted wave which is distorted from the sinusoidal wave and which is accompanied by harmonic waves, consideration should be directed to a plurality of frequency components which result from the harmonic waves with a preselected interval of frequency on the axis of frequency to calculate a sum of the frequency components and the first frequency component in the above-mentioned manner.

What is claimed is:

1. A method of monitoring a logarithmic frequency spectrum which is related to an input signal, and of extracting a value of an envelope parameter specifying said logarithmic frequency spectrum, said logarithmic frequency spectrum being variable and comprising a first frequency component which is variable in frequency and which has an approximate envelope of said logarithmic frequency spectrum, and a second frequency component which includes a preselected frequency superposed on said first frequency component and which varies said approximate envelope determined by said first frequency component, said logarithmic frequency spectrum being converted by an inverse Fourier transform into a cepstrum which has a first frequency component corresponding to said first frequency component and a second frequency component corresponding to said second frequency component, said first and said second frequency components having a first peak at a predetermined frequency and a second peak remote from said first peak by a frequency distance determined by said preselected frequency, respectively, said method comprising the steps of:

folding said second frequency component along a fold axis passing through said second peak to produce a folded frequency component;

shifting said folded frequency component in frequency toward said first peak to make said fold axis coincide with said first peak and to produce a peak controlled frequency component; and summing up said first frequency component and said peak controlled frequency component with said fold axis coincident with said first peak to produce an ultimate frequency component corresponding to said value of said envelope parameter.

2. A method as claimed in claim 1, said second frequency component comprising a first and a second part which are higher in frequency than said second peak and not higher in frequency than said second peak, respectively, wherein said folding step comprises the steps of:

inverting the direction of the frequency of said second part with respect to said fold axis to produce an inverted frequency part; and superposing said inverted quefrency part on said first part to produce said folded frequency component.

3. A method as claimed in claim 1, said cepstrum having a third frequency component which is substantially a mirror image of said second frequency component with respect to said predetermined frequency, wherein said controlling step comprises the steps of:

combining said second frequency component with said third frequency component into an intermediate frequency component; and producing said intermediate frequency component as said peak controlled frequency component.

4. A method as claimed in claim 3, said second frequency component having said second peak at an additional frequency remote from said predetermined frequency by said frequency distance and comprising a first and a second part which are higher than said additional frequency and not higher than said additional frequency, respectively, said third frequency component having a third peak which is substantially a mirror image of said second peak with respect to said predetermined frequency and a first and a second part which are substantially mirror images of said first and said second parts with respect to said predetermined frequency, respectively, wherein said combining step comprises the steps of:

separating said first part and said second part from said second and said third frequency components, respectively; and superposing the first part separated from said second frequency component on the second part separated from said third frequency component to obtain said intermediate frequency component.

5. A device for use in extracting a value of an envelope parameter specifying a logarithmic frequency spectrum which is related to an input signal, said logarithmic frequency spectrum being variable and comprising a first frequency component which is variable in frequency and having an approximate envelope of said logarithmic frequency spectrum and a second frequency component which includes a preselected frequency superposed on said first variable frequency component and which varies said approximate envelope determined by said first variable frequency component, said device comprising:

cepstrum producing means, responsive to said input signal, for producing a cepstrum signal representative of a cepstrum which has a first and a second frequency component corresponding to said first and said second variable frequency components, respectively, said first and said second frequency components having a first peak at a predetermined quefrency and a second peak at an additional quefrency remote from said first peak by a quefrency distance determined by said preselected frequency, respectively; and processing means, coupled to said cepstrum producing means, for processing said cepstrum signal, including means for shifting said second frequency component in frequency toward said first frequency component so as to make said first peak coincide with said second peak and thereafter to calculate a sum of the first and the second frequency components having the first and the second peaks coincident with each other, said processing means thereby specifying said value of said envelope parameter by said sum of said first and said second frequency components.

* * * * *